US006502870B1

(12) United States Patent
Luo

(10) Patent No.: US 6,502,870 B1
(45) Date of Patent: Jan. 7, 2003

(54) ELECTRIC MOTOR-DRIVEN LOCKING DEVICE FOR LOCK

(76) Inventor: Shizhong Luo, 101 A Unit, 79 Building, No. 19 Region, Bao'an District, 518101 Shenzhen, Guangdong (CN)

( * ) Notice: Subject to any disclaimer, the term of this patent is extended or adjusted under 35 U.S.C. 154(b) by 0 days.

(21) Appl. No.: 09/647,517

(22) PCT Filed: Dec. 9, 1999

(86) PCT No.: PCT/CN99/00205

§ 371 (c)(1),
(2), (4) Date: Sep. 29, 2000

(87) PCT Pub. No.: WO00/42278

PCT Pub. Date: Jul. 20, 2000

(30) Foreign Application Priority Data

Jan. 10, 1999 (CN) ..... 99202022

(51) Int. Cl.[7] ..... E05C 3/06
(52) U.S. Cl. ..... 292/201; 292/216; 292/DIG. 23
(58) Field of Search ..... 292/201, DIG. 23, 292/216

(56) References Cited

U.S. PATENT DOCUMENTS 3,854,310 A * 12/1974 Paull et al. ..... 70/280
4,454,776 A * 6/1984 Barge et al. ..... 70/279
4,949,563 A * 8/1990 Gerard ..... 292/201 X
5,713,613 A * 2/1998 Honma et al. ..... 292/201

FOREIGN PATENT DOCUMENTS

| | | | |
|---|---|---|---|
| CN | 1203995 | A | 1/1999 |
| DE | 3507349 | A1 | 9/1986 |
| DE | 3507349 | * | 9/1986 |
| DE | 4404778 | C1 | 7/1995 |
| DE | 4407912 | A1 | 8/1995 |
| DE | 4407912 | * | 8/1995 |
| EP | 372116 | A1 | 6/1990 |
| FR | 2695675 | A1 | 3/1994 |
| GB | 2048362 | A | 12/1980 |
| GB | 2048362 | * | 12/1980 |
| JP | 9105259 | A | 4/1997 |
| JP | 9184336 | A | 7/1997 |
| JP | 9209627 | A | 8/1997 |
| WO | WO 91/00405 | A1 | 1/1991 |

* cited by examiner

*Primary Examiner*—Teri Pham Luu
(74) *Attorney, Agent, or Firm*—Alston & Bird LLP

(57) ABSTRACT

A releasing buckle device of electrical lock comprises case, micro-motor, worm-shaft and worm-wheel, and locking latch body and so on. It also comprises swing buckle, twist spring, wherein the swing buckle and the twist spring is set on the lock body beside worm-wheel through pin shaft. The buckle end of the swing buckle clutches or withstands the propping part corresponding to the body of the locking latch. It can be tugged during locking and can be released off the locking latch during unlocking buckle, and the micro-motor used for driving can be installed precisely orientated.

16 Claims, 5 Drawing Sheets

ELECTRIC MOTOR-DRIVEN LOCKING DEVICE FOR LOCK

FIELD OF THE INVENTION

The present invention relates to a releasing buckle device of the lock, especially to a releasing buckle device of the electrical lock.

BACKGROUND OF THE INVENTION

The technology which has been disclosed of the releasing buckle device of electrical lock may be found in Chinese Patent Application Nos. 97112840.5 and 97220148.3 by the present applicant. The characteristics of these devices include employing micro-motor, worm-shaft and worm-wheel decelerating mechanism, shocking the plucking point of round shaft shaped-buckle or plate shaped-buckle through the swing pin set eccentrically on the worm wheel to release the buckle off the locking latch so as to control the opening of the lock. The disadvantages of the above technology are: the inertia mass of the round shaft shaped-buckle and plate shaped-buckle is more over than the resilience of the recovering spring. It is easy to produce wrong action when very strong shock is subjected; the frictional resistance is big during reciprocal move of the round shaft shaped-buckle and the power consuming is increased; under the effect of the recovering spring the round shaft shaped-buckle and the plate shaped-bucket can not keep unlocking condition after the buckle releasing off, i.e. can not unlock with time delay; the micro-motor is installed in the side through hole on the case and not easy to adjust the engaged gap of the worm-shaft and the worm wheel; the back end of the micro-motor is limitless and easy to move, and can not be fixed.

The object of the present invention is to provide a releasing buckle device. It can not make wrong action during shocking, low frictional resistance, low power consuming, retaining unlocking condition after releasing buckle off, and the micro-motor used for driving can be installed precisely orientated.

SUMMARY OF THE INVENTION

The technical scheme is that: a releasing buckle device of electrical lock comprises case, micro-motor, worm-shaft and worm-wheel, swing pin, and locking latch body. It is also comprises swing buckle, twist spring wherein the swing buckle and the twist spring are set on the lock body beside the worm wheel through pin shaft. The buckling end of the swing buckle clutches or withstands the propping part corresponding to the body of the locking latch. It can be tugged during locking and can be released off the locking latch during unlocking. The another end of the swing buckle is a withstanding end of the swing pin setting on the moving guide of the swing pin correspondingly. And can withstand the swing pin bearing shock revolution of the swing pin so as to release the end clutched locking latch off the propping part of the locking latch.

Said micro-motor fixed worm shaft is set in the horizontal groove of the case. The horizontal groove is formed of shield and wall plate. The screw with taper end is screwed in the thread hole on the wall plate of the case. Its taper end presses the cylindrical surface of the micro-motor body.

Said swing buckle is a bend shaped slender shaft with a big head. In the middle part at the transition from big head to the small head is provided with pin shaft and the twist spring. The end of the locking buckle is of big head shape.

On one side of the locking latch body is provided with propping part, the propping part is a notch with step. Said notch is fitted correspondingly with the end of the locking buckle of the swing buckle. While locking, the end of the locking buckle is slantingly supported in the stepped notch on the side of the locking latch, the withstanding end of the swing pin is a slender shaft located on the moving guide correspondingly to bear the shocking force of the swing pin.

Said swing buckle is of non-symmetrical T shape and the end of the locking buckle is a transverse shoulder of T shape. The withstanding end is a middle upright shaft. At the intersection of the T shaped transverse shoulder and the upright shaft are provided with pin shaft and the twist spring. On one end of the transverse shoulder is provided with a stake pin restricted opening of the locking latch. The another end of the transverse shoulder withstands correspondingly the protrusion on the case. Said body of the locking latch withstands stake pin. The body of the locking latch pivots the case through pin shaft. On the case is provided with Jack with a squeezing slop face, the pushing plate can project into the jack to push against the squeezing slop face. On the other end of the pushing plate is provided with spring, the pushing plate connects the tongue of the lock firmly.

Said swing buckle is of slender shape. At the middle is provided with pin shaft and twist spring. On one side of the locking buckle end of the swing buckle is provided with seizing opening. The another side is a plane. On the lower part of the propping part of the locking latch body is provided with sink of rectangular shape. The locking buckle end of the swing buckle can withstand one bottom side, on the other bottom side of the sink and the corresponding plane location after locking buckle end releasing off the locking latch is provided with permanent magnet.

Said swing buckle is of non-symmetrical "shoe-shaped gold" shape. At its middle is provided with pin shaft and twist spring, the upper of the locking buckle end is of hook shape and the lower is a plane. Said locking latch body comprises plucked part of the locking tongue. On its outside edge of the rotational center there is a step hooked on to the locking buckle end. The outside edge with a distance approximated an arc of the swing buckle off the step is formed with cam shape. On the case corresponding to the unlocking releasing buckle position of the lower plane of the locking buckle end is provided with permanent magnet. While rotating it in the direction of unlocking, the cam pushes swing buckle to release it off the attraction of the permanent magnet.

The section of said permanent magnet is of trapezoid shape and inlaid on the locking latch body and case.

Between said shield and micro-motor thin pad may be increased or decreased.

On the ends of both said shield and wall plate there are steps respectively, the steps seize two ends of the micro-motor body.

To compare with the present technology the advantages of the present invention are: the frictional resistance while swing buckle reduced mass swings releasing buckle around the pin shaft is small, low power consuming, the resilience of the restoring twist spring is larger than the inertia mass of the swing buckle. Strong shock can not cause unlocking by wrong action. While swing buckle swings to the end after releasing off it will be attracted by the permanent magnet. It can be unlocked with delay-time. The engaged gap of the worm shaft and the worm wheel is adjustable because of the micro-motor is installed in the horizontal groove of the case, after the screw with taper end pressing micro-motor in the horizontal groove its 6 (six) freedoms are restricted.

BRIEF DESCRIPTION OF THE DRAWINGS

Having thus described the invention in general terms, reference will now be made to the accompanying drawings, which are not necessarily drawn to scale, and wherein:

BRIEF DESCRIPTION OF THE DRAWINGS

Figure 1:
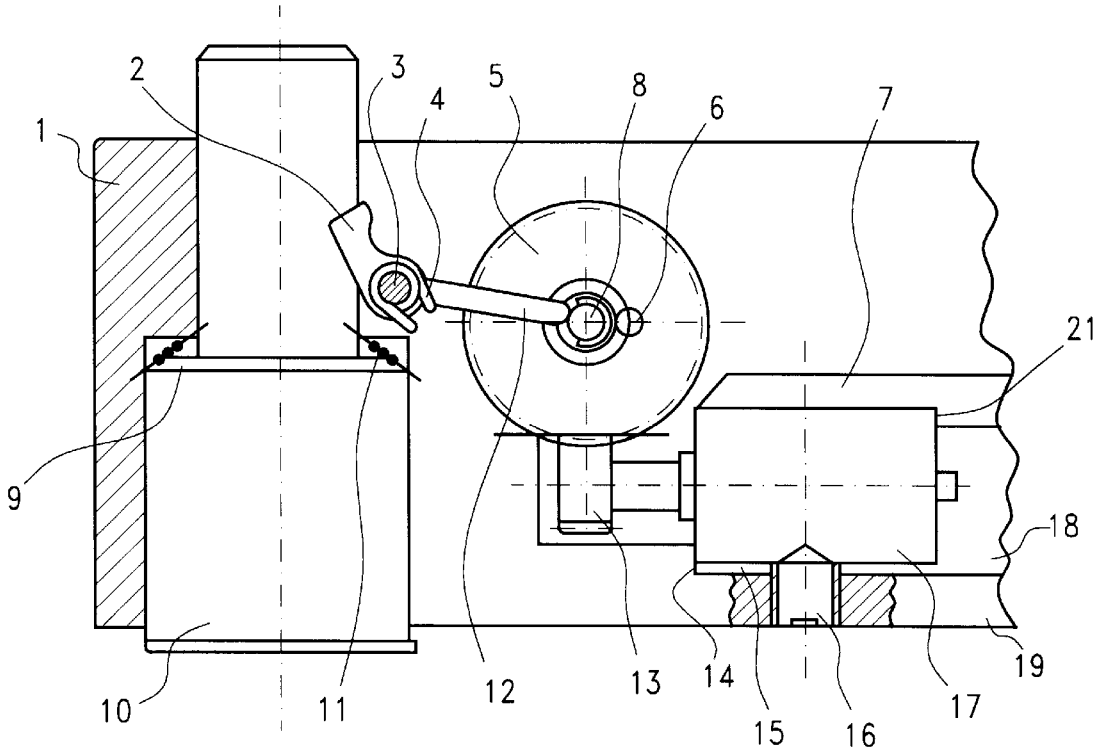

FIG. 1 is a main view of the first embodiment of the present invention.

Figure 2:
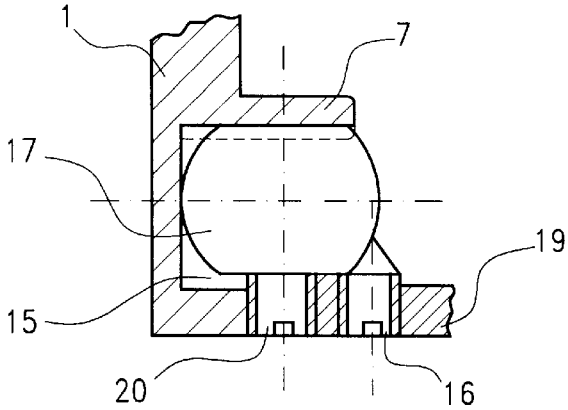

FIG. 2 is A—A sectional view of FIG. 1.

Figure 3:
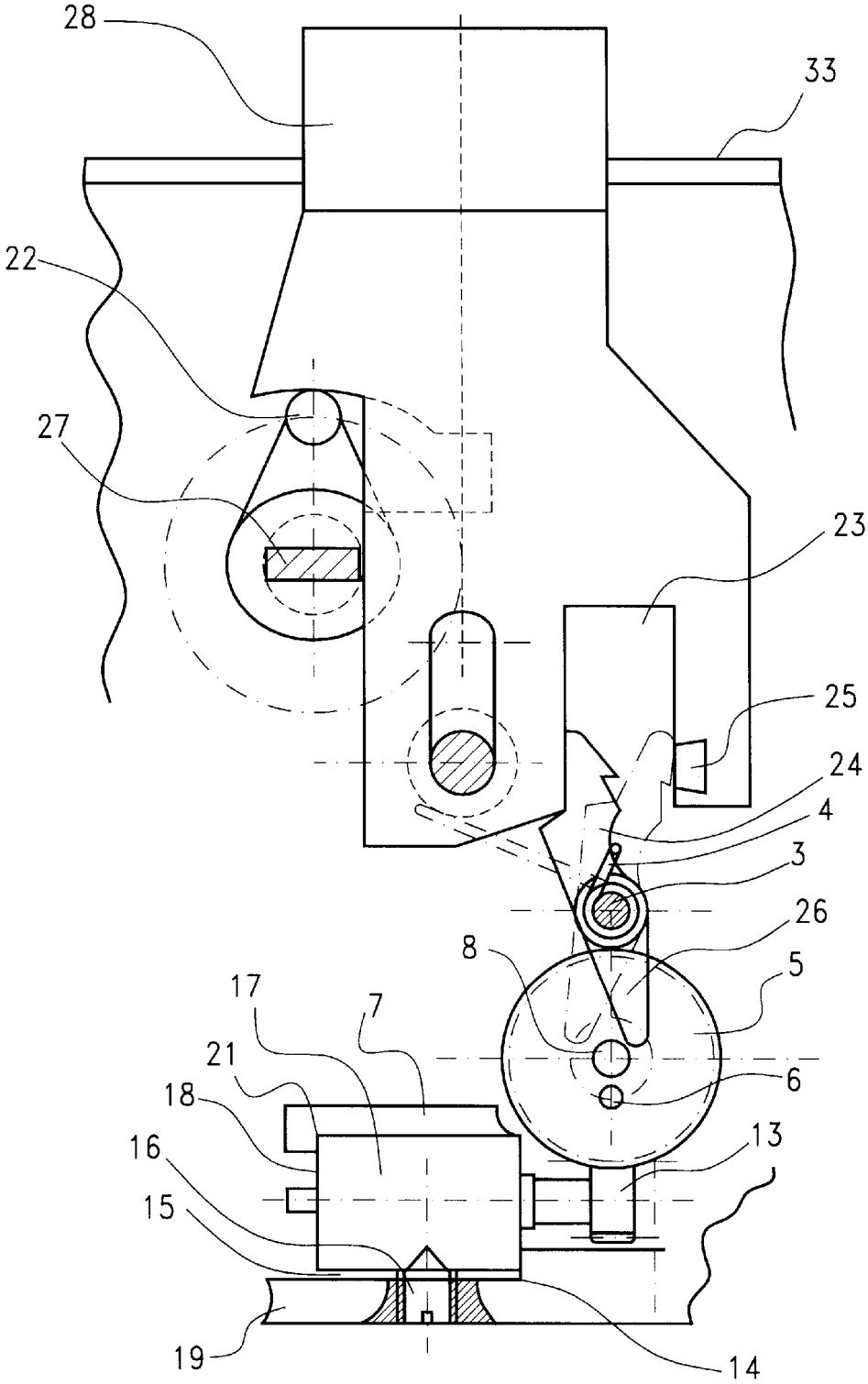

FIG. 3 is a main view of the second embodiment of the present invention.

Figure 4:
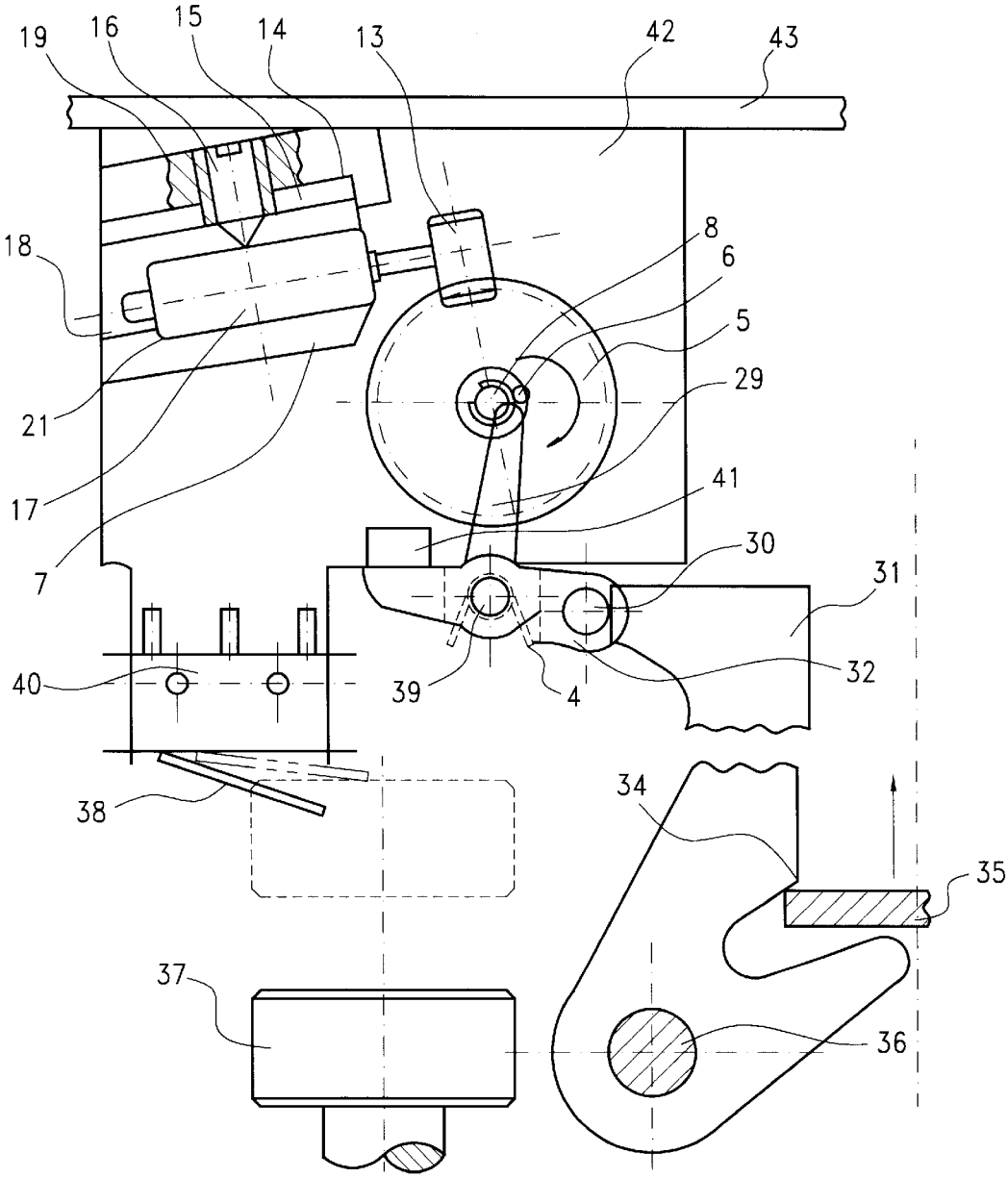

FIG. 4 is a main view of the third embodiment of the present invention.

Figure 5:
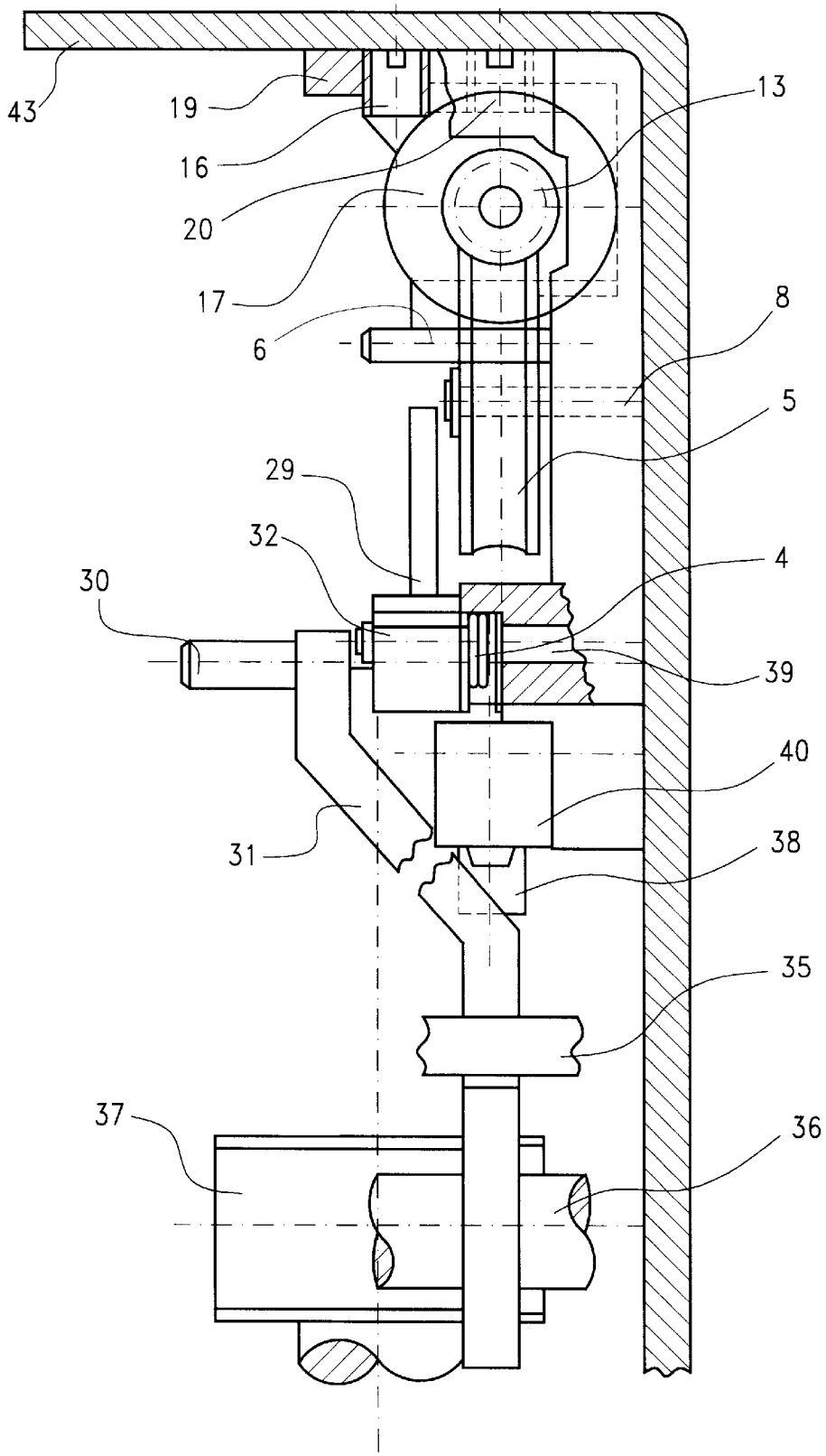

FIG. 5 is right elevation of FIG. 4.

Figure 6:
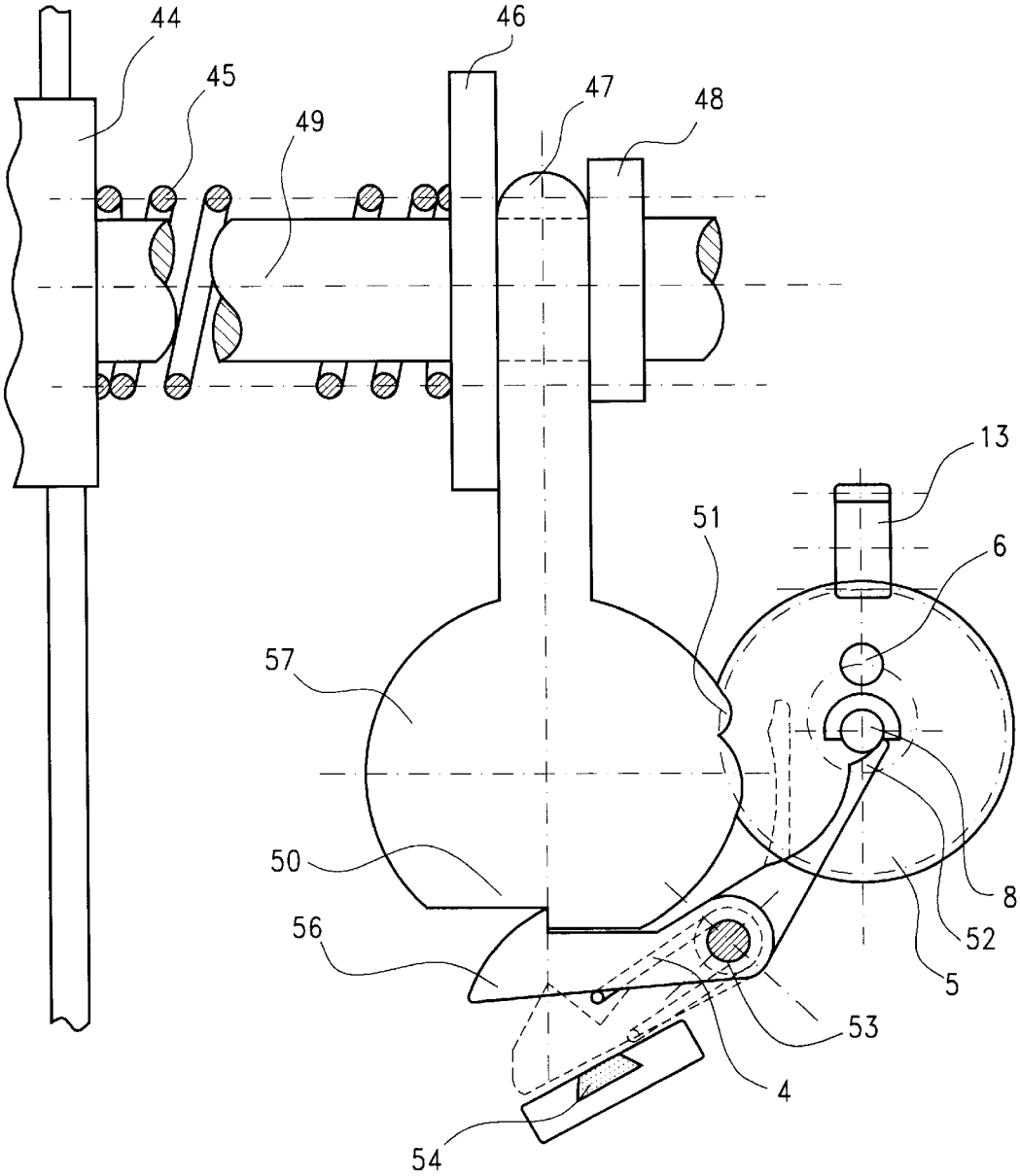

FIG. 6 is a main view of the forth embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1 and 2 show one embodiment of the releasing locking device of the present invention. The releasing locking device is comprised of a case 1. The case 1 has a step hole 9 within which a tensile spring 11 and locking latch 10 are located. A worm wheel 5, attached via a central axle 8 is provided on the case 1 near the locking latch 10. A swing pin 6 is located on the worm wheel 5, adjacent the central axle 8. A worm shaft 13 is provided to engage both the worm wheel 5 via an engaging gap and a micro-motor 17. A swing buckle 2 is installed on the case proximate to the worm wheel 5 and locking latch 10. The swing buckle 2 has a large head of a bent shape at one end and a slender shaft 12 at the other end rotatably engaged with the worm wheel 5. A pin shaft 3 and a twist spring 4 are installed in the middle section of the swing buckle 2 between the large head and slender shaft 12. The swing buckle 2 is installed on the case proximate to the worm wheel 5 and locking latch 10. The large head of the swing buckle 2 is slantingly supported in a stepped notch on the side of the locking latch 10. The slender shaft 12 of the swing buckle 2 is positioned to engage the moving guide of the swing pin 6 when the swing pin 6 is put into motion as the worm 5 wheel rotates. The slender shaft of the swing buckle 2 also forms a reinforced lever to enhance the shocking force of the swing pin, thus bearing the shock of rotation.

A horizontal groove 18 is formed on the case 1 of a shield 7 and a wall plate 19. Two ends of both the wall plate 19 and shield 7 have a step (i.e. a 90° angle) 14 and 21, respectively. A micro-motor 17 is provided in the horizontal groove 18. Two ends of the body of the micro-motor 17 are restricted by the two steps 14 and 21 and cannot move axially. The micro-motor 17 is connected to the worm shaft 13. The micro-motor is pushed to the shield 7 by a screw 20 having a flat end. Between the shield 7 and the micro-motor 17 a pad may be provided to increase or decrease the engaging gap of the worm shaft 13 and worm wheel 5. Between the micro-motor 17 and the wall plate 19 a gap 15 remains for installation convenience. A screw 16 having a tapered end is screwed in the thread hole on the wall plate 19 of the case, its tapered end pressing on the cylindrical surface of the body of the micro-motor 17. A tapered screw serves many functions, for example, such as restricting the six freedoms of the body of the micro-motor 17.

During unlocking, an unlocking current is input to the micro-motor 17 from a controlling circuit (not shown). The worm wheel 5 rotates one circle counter clock-wise, thus causing the swing pin 6 to engage the swing buckle's long slender shaft 12 to swing it around the pin shaft 3 clock-wise. The large head of the swing buckle 2 releases off the stepped notch on the side face of the locking latch 10. The locking latch 10 is pushed by the tensile spring 11 downward to open the lock. During locking, the locking latch 10 is pushed upward and under the effect of the twist spring 4 the large head of the swing buckle 2 engages the stepped notch on the side face of the locking latch 10 automatically.

FIG. 3 is yet another embodiment of the present invention. A worm wheel 5 is rotatably installed via a central axle 8 onto the lower part of a case 33 near a shield 7. A horizontal groove 18 on the lower part of the case 33 is formed of a shield 7 and a wall plate 19. The ends of both wall plate 19 and shield 7 have a step (i.e. a 90° angle) 14 and 21, respectively. The micro-motor 17 and worm shaft 13 are installed in the horizontal groove 18. The two ends of the micro-motor 17 body are restricted by the above two steps 14 and 21, such that the micro-motor 17 may not move axially. Between the shield 7 and micro-motor 17 a pad may be provided to increase or decrease the engaging gap of the worm shaft 13 and worm wheel 5. Between the micro-motor 17 and wall plate 19, a gap 15 exists for installation convenience. A screw 16 having a tapered end is screwed in the thread hole on the wall plate 19, its tapered end pressing on the cylindrical face of the body of the micro-motor 17. A notch 23 of preferably a rectangular shape exists on and is part of the lower part of the locking latch 28. A permanent magnet 25 is attached on one side of the notch. The magnet preferably has a trapezoidal shape. A swing buckle 24 is provided having a first end engaging and located inside the rectangular notch 23 and an opposite, or second end 26 engaging the worm wheel 5. On the middle section of the swing buckle 24, a twist spring 4 and pin shaft 3 are provided.

During unlocking, a current is input to the micro-motor 17 from a controlling circuit (not shown). The worm wheel 5 rotates one circle counter clock-wise. The swing pin 6 engages the second end 26 of the swing buckle 24, causing it to swing clock-wise around the pin shaft 3 to move the swing buckle 24. When it swings to the end, one side of the upper part of the swing buckle 24 is attracted by the permanent magnet 25. Afterwards, a plucked part 22 of the locking latch can be rotated clock-wise with any time delay using a key or button 27 to move the locking latch 28 downward for unlocking. The inlaid permanent magnet 25 also moves downward thereby releasing the magnetic attraction to the swing buckle 24. Under the effect of the twist spring 4, the swing buckle 24 having lost its attraction to the permanent magnet 25, swings counter clock-wise, abutting a side of the rectangular notch 23 opposite the side of the permanent magnet 25, thereby keeping a distance such that the swing buckle 24 will not be attracted to the permanent magnet 25. When rotating the plucked part 22 of the locking latch counter clock-wise, thus moving the locking latch upward for locking, the twist spring 4 engages the swing buckle 24 thereby causing the swing buckle 24 to move to the side of the rectangular notch 23 having the permanent magnet 25.

FIGS. 4 and 5 show yet another embodiment of the present invention. The worm wheel 5 is installed rotatably on the right side of the case 42 via a central axle 8. A horizontal groove 18 is formed of a shield 7 and a wall plate 19 on the left side of the case 42. The ends of both the wall plate 19 and shield 7 have a step (i.e. a 90° angle) 14 and 21, respectively. After the micro-motor 17 is put into the horizontal groove 18, it is fixably attached to the worm shaft 13. The worm shaft 13 is engaged to the worm wheel 5 at an end opposite the end engaged with the micro-motor 17. The steps 14 and 21 restrict the two ends of the micro-motor body and thus the micro-motor body cannot move axially. Between the shield 7 and the micro-motor 17 a pad may be provided to increase or decrease the engaging gap of the worm shaft 13 and worm wheel 5. A screw 20 with a flat end engages the micro-motor 17, pushing it toward the shield 7. Between the micro-motor 17 and the shield 7, a gap 15 remains for installation convenience. A screw 16 having a tapered end is screwed into the thread hole on the wall plate. 19, its tapered end pressing the cylindrical surface of the body of the micro-motor 17. The swing buckle 32 is formed of a non-symmetrical T-shape. At the intersection of the transverse shoulder of the T-shape and the upright shaft 29, a twist spring 4 and pin shaft 39 are located. On the right end of the transverse shoulder a stake pin 30 is provided, thereby restricting the movement of the locking latch 31. The swing buckle 32 and twist spring 4 are installed on the case beside the worm wheel 5 via the pin shaft 39. The left end of the transverse shoulder of the swing buckle 32 balances the inertia mass of the right end and, under the effect of the twist spring 4, abuts the side face of a protrusion 41 of the case.

During unlocking, an unlocking current is input to the micro-motor 17 from a controlling circuit (not shown). Worm wheel 5 then rotates one circle clockwise. The swing pin 6 engages the upright shaft 29 of the swing buckle 32, thereby causing it to swing counter clock-wise around the pin shaft 39. A spring pushing plate 35 pushes the sloped face 34 of the locking latch 31 causing the locking latch 31 to swing counter clock-wise around the stake pin 36. The sloped face 34 then moves against the pushing plate 35 and the back end 37 of the sloped tongue of the lock moves upward continually. When it reaches the final resting point, the sloped tongue of the lock is in the open position. At this time, the lever 38 of the switch 40 is engaged with the back end 37 of the lock. The switch 40 can either switch on or off the unlocking current or feed back the electrical signal of unlocking and locking.

Yet another embodiment is shown in FIG. 6. A worm wheel 5 is installed via a central shaft 8 on the case near the plucked part 57 of the locking tongue. The installation of the worm shaft 13 and micro-motor 17 (not shown) are provided in the same manner as above. The swing buckle 56, having first and second ends and a middle section is formed of a non-symmetrical "shoe shaped gold" shape. A twist spring 4 is set approximately near or at the middle section of the swing buckle 56. The swing buckle 56 is located on the case beside the plucked part 57 of the locking tongue and the worm wheel 5. The second end of the swing buckle comprises first and second sides, the first side being a hook shape movably engaging a step 50 of the plucked part 57, the second side being planar and in a position such as to coincide with a permanent magnet 54. At the lower outside edge of the revolving center of plucked part 57 of the locking tongue there is a step 50 of a size and at a location such that it is capable of engaging the second end of the swing buckle 56. At a particular distance from the step 50 is a cam 51 located in such a place to engage the first end of the swing buckle 56 engaging the worm wheel 5. A permanent magnet 55 having preferably a trapezoidal shape is inlaid in a notch of a flat column 54 of the case.

During unlocking, a control circuit (not shown) inputs a current to the micro-motor (not shown). The worm wheel 5 rotates one circle clockwise. The swing pin 6 engages the upper end 52 of the swing buckle, causing it to swing around the pin shaft 53 counter clock-wise. The second end of the swing buckle 56 then moves away from the step 50 of the plucked part 57 of the locking tongue. As the swing buckle swings to the final resting position, it is attracted by the permanent magnet 55. After that, the locking device may be unlocked with any time delay. By locating the plucked part 57 of the locking tongue clock-wise, the plucked shaft 47 pushes a space washer 48 towards the right side of the slope-locking tongue shaft 49, thereby moving it to the right. While the spring 45 is engaged, the slope-locking tongue 44 is re-locked and the plucked part 57 of the locking tongue swings counter clock-wise with the space washer 48 moving left. The plucked shaft 47 is stopped from further movement by a shield 46. After pressing a spring 45, the slope-locking tongue 44 retracts into the case of the lock. At about the same time, the cam 51 pushes the upper end 52 of the swing buckle, thereby moving the swing buckle 56 clock-wise, moving out of the range of attraction to the permanent magnet 55. Under the effect of the twist spring 4, the swing buckle 56 engages the outside edge of the plucked part 57 of the locking tongue ceasing rotation of the plucked part 57.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A locking device for an electrical lock comprising:

a micro-motor engaging a worm shaft;

a rotatable worm wheel engaging the worm shaft at an end of the worm shaft opposite the micro-motor, said worm wheel fixably attached within the locking device by a central axle, said micro-motor inputting an electrical current to the worm wheel via the worm shaft causing said worm wheel to rotate;

a swing pin fixed at a location on said worm wheel proximate to the central axle, said swing pin rotating as said worm wheel rotates;

a movable swing buckle having first and second ends and a middle section, said first end adjacent the worm wheel and in a position to engage the swing pin as the worm wheel rotates, said swing buckle movably attached within the locking device by a pin shaft located in the middle section of the swing buckle;

a twist spring located adjacent the pin shaft in the middle section of the swing buckle; and a locking latch having a notch capable of receiving the second end of said swing buckle and when said worm wheel rotates causing said swing pin to engage said swing buckle, moving said swing buckle away from said notch, the locking latch is moved by a tensile spring to open the locking device, and when the locking latch is moved into a locking position, the twist spring is capable of moving said second end of said swing buckle causing the swing buckle to engage the notch of the locking latch, wherein said swing buckle is of a slender shape and the second end of the swing buckle further comprises a first notched side and a second planar side, and wherein said locking latch further comprises a magnet located to engage the second planar side of the second end of said swing buckle.

2. The locking device for an electrical lock of claim 1, wherein the magnet is of a trapezoidal shape.

3. An electrical lock comprising the locking device of claim 1.

4. An electrical lock comprising the locking device of claim 2.

5. A locking device for an electrical lock comprising:

a micro-motor engaging a worm shaft;

a rotatable worm wheel engaging the worm shaft at an end of the worm shaft opposite the micro-motor, said worm wheel fixably attached within the locking device by a central axle, said micro-motor inputting an electrical current to the worm wheel via the worm shaft causing said worm wheel to rotate;

a swing pin fixed at a location on said worm wheel proximate to the central axle; said swing pin rotating as said worm wheel rotates;

a movable swing buckle having first and second ends and a middle section, said first end adjacent the worm wheel and in a position to engage the swing pin as the worm wheel rotates, said swing buckle movably attached within the locking device by a pin shaft located in the middle section of the swing buckle;

a twist spring located adjacent the pin shaft in the middle section of of the spring buckle; and a locking latch having a notch capable of receiving the second end of said swing buckle and when said worm wheel rotates causing said swing pin to engage said swing buckle, moving said swing buckle away from said notch, the locking latch is moved by a tensile spring to open the locking device, and when the locking latch is moved into a locking position, the twist spring is capable of moving said second end of said swing buckle causing the swing buckle to engage the notch of the locking latch, wherein said swing buckle is of non-symmetrical shape, wherein said second end of the swing buckle further comprises a first hook-shaped side and a second planar side, and said locking latch further comprising a plucked part and a locking buckle end, said locking buckle end comprising a step.

6. The locking device for an electrical lock of claim 5, further comprising a shield and wall plate, said shield and said wall plate forming a horizontal groove within which said micro-motor and said worm shaft are fixably attached.

7. The locking device for an electrical lock of claim 6, further comprising a thin pad between said shield and micro-motor.

8. The locking device for an electrical lock of claim 6, wherein the wall plate and the shield further comprise steps, the steps engaging two ends of the micro-motor.

9. An electrical lock comprising the locking device of claim 5.

10. An electrical lock comprising the locking device of claim 6.

11. An electrical lock comprising the locking device of claim 7.

12. An electrical lock comprising the locking device of claim 8.

13. The locking device for an electrical lock of claim 5, further comprising a column positioned to engage the second end of the swing buckle when the second end of the swing buckle is not engaged with the notch of the locking latch, said column comprising a magnet.

14. The locking device for an electrical lock of claim 5, wherein the locking latch further comprises a cam located in a position to engage the first end of the swing buckle when the first end of the swing buckle is rotated away from the central axle of the worm wheel.

15. The locking device for an electrical lock of claim 5, wherein the notch further comprises a magnet.

16. A locking device for an electrical lock comprising:

a micro-motor engaging a worm shaft;

a rotatable worm wheel engaging the worm shaft at an end of the worm shaft opposite the micro-motor, said worm wheel fixably attached within the locking device by a central axle, said micro-motor inputting an electrical current to the worm wheel via the worm shaft causing said worm wheel to rotate;

a swing pin fixed at a location on said worm wheel proximate to the central axle, said swing pin rotating as said worm wheel rotates;

a movable swing buckle having a T-shape form comprising a transverse shoulder and an upright shaft, said upright shaft adjacent the worm wheel and in a position to engage the swing pin as the worm wheel rotates, said swing buckle movably attached within the locking device by a pin shaft located at a point of intersection of the upright shaft and the transverse shoulder, said transverse should positioned such that one end is capable of engaging a protrusion on the locking device and another end is capable of engaging a locking latch;

a twist spring located adjacent the pin shaft of the swing buckle;

a locking latch comprising a spring pushing plate, a sloped face engaging the spring pushing plate and a back end;

a switch capable of switching on or off the unlocking current or feed back the electrical signal of unlocking and locking; and a lever attached to said switch and positioned to receive the back end of the locking latch, and when said worm wheel rotates causing said swing pin to engage said swing buckle, moving said swing buckle away from said protrusion, the spring pushing plate is moved by the sloped face in causing said back end to move in an opposite direction and contact said lever, said lever then contacting the switch to unlock said locking device, wherein said swing buckle is of non-symmetrical shape, wherein said second end of the swing buckle further comprises a first hook-shaped side and a second planar side, and said locking latch further comprising a plucked part and a locking buckle end, said locking buckle end comprising a step.

* * * * *